United States Patent [19]

Spanel et al.

[11] 4,062,308

[45] Dec. 13, 1977

[54] TWO-PILE HEIGHT YARN FEED FOR CONVENTIONAL TUFTING MACHINE

[75] Inventors: Abram N. Spanel, Princeton, N.J.; P. Frank Eiland, Stamford; David R. Jacobs, New Canaan, both of Conn.

[73] Assignee: Abram N. Spanel, Princeton, N.J.

[21] Appl. No.: 699,906

[22] Filed: June 25, 1976

[51] Int. Cl.[2] ..... D05C 15/18

[52] U.S. Cl. ..... 112/79 A; 112/266; 226/113; 226/118

[58] Field of Search ..... 112/79 R, 79 A, 79 FF, 112/80, 79.5, 221, 219 A, 262, 266; 139/449, 446; 226/118, 113, 104

[56] References Cited

U.S. PATENT DOCUMENTS

| | | | |
|---|---|---|---|
| 2,522,582 | 9/1950 | Newman | 112/221 |
| 3,439,638 | 4/1969 | Zuk | 112/219 A |
| 3,678,968 | 7/1972 | Juillard | 139/446 |
| 3,937,156 | 2/1976 | Spanel | 112/79 FF |

*Primary Examiner*—H. Hampton Hunter
*Attorney, Agent, or Firm*—J. Rodman Steele, Jr.

[57] ABSTRACT

A method of and apparatus for feeding yarn to needles of a conventional tufting machine in which the yarn is controlled to permit the feeding of at least two different lengths per needle to produce pile tufts of varying heights. A series of yarn pullers and clamps are utilized to draw and meter the yarn from the creel. Different pullers are utilized to provide the varying pile heights. The pullers or plungers may be driven by band-like members which are engageable upon selection with a continuously oscillating shaft.

15 Claims, 13 Drawing Figures

Fig 5
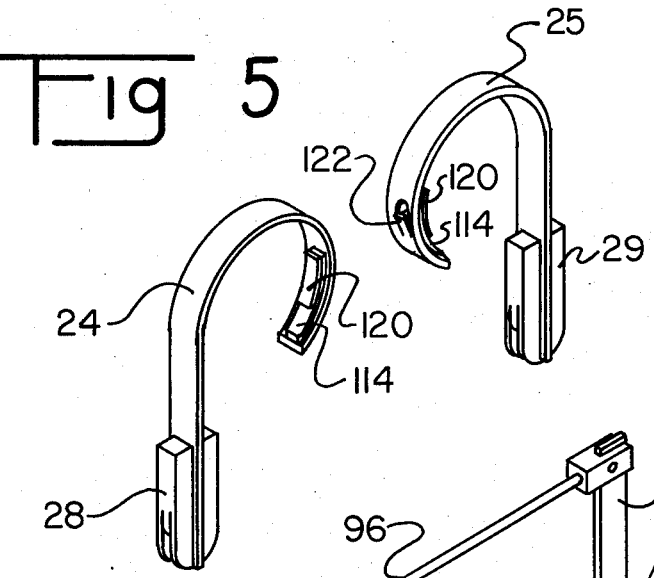
Fig 6
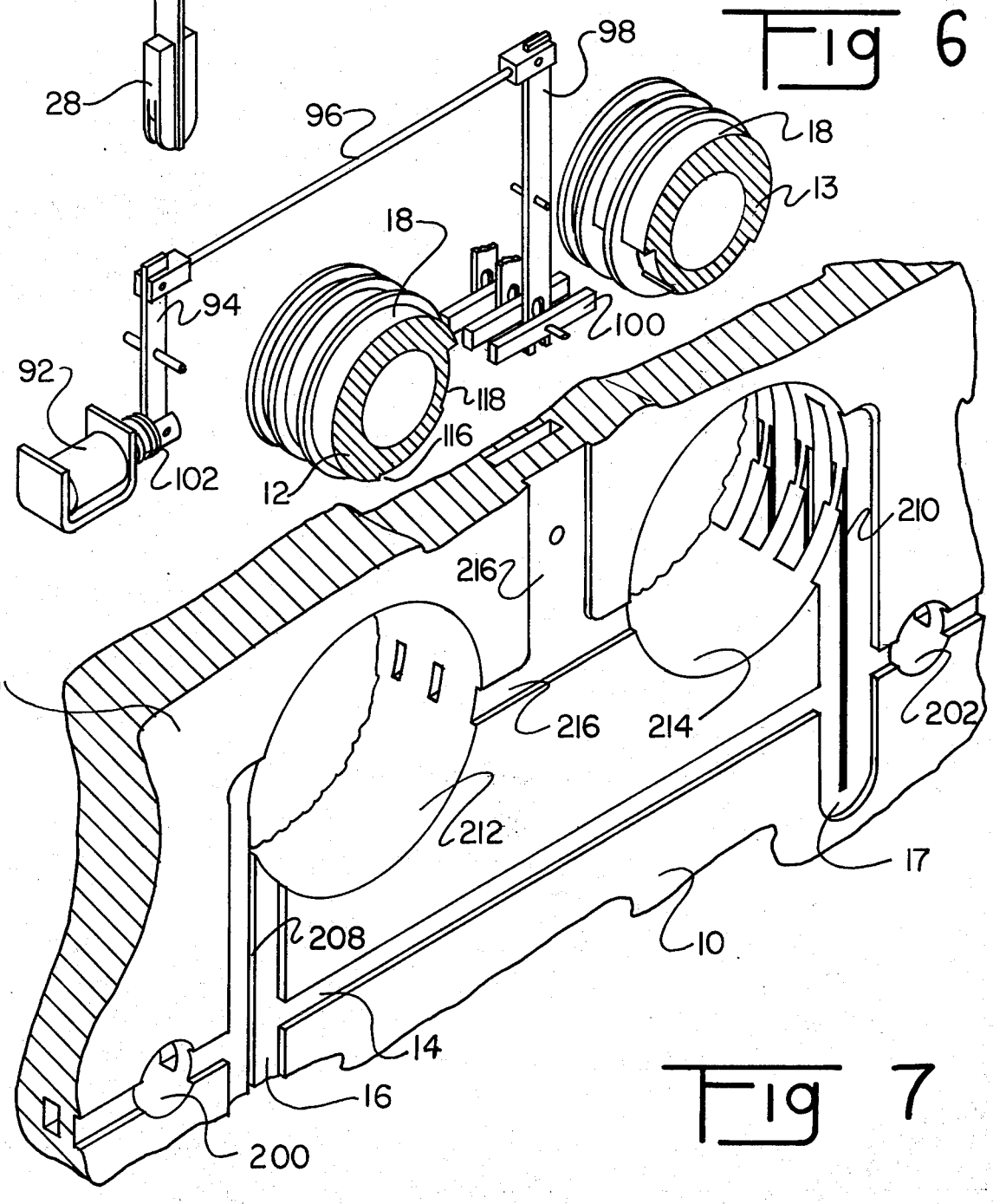
Fig 7

TWO-PILE HEIGHT YARN FEED FOR CONVENTIONAL TUFTING MACHINE

BACKGROUND OF THE INVENTION

The subject invention discloses a method and means of tufting in which different pile heights may be obtained on conventional tufting machines by a modified yarn feed process. With more particularity, in conventional tufting, standard needles are driven through a backing layer by one of many types of needle drives to enable loops of yarn to be deposited in the backing layer and held in place by a looper positioned below the backing layer as the tufting needles withdraw. Each needle receives a single strand of yarn and the size of the loop formed will be determined by the amount of yarn fed during the tufting cycle.

Presently, two-pile height (or additional pile heights) tufting is known; however, the systems utilized for such tufting are quite complex. Typically, all yarn being delivered to the different needles is delivered by one of a number of feed rolls, each of such rolls being driven by magnetic clutches which connect each of the feed rolls to one of a number of shafts. The shafts are set to run at different speeds and thus, the feed roll speed is varied by controlling the clutches. Such machinery with large clutches and associated gears is quite cumbersome and, accordingly, patterns for the carpets are limited to a realistic number of repeats across the width of each tufted carpet.

Typically, there are ten such repeats across a standard width of carpet which means that the same pattern will be repeated in ten different places across the carpet. Since in each pattern one needle will function identically to a corresponding needle in each of the other repeats, yarns for each of these needles which produce identical patterns will be fed by a common feed roll. Thus, from any one feed roll, yarn will be fed to needles positioned across the width of the carpet. For example, if there are 1200 needles and 10 repeats, the chosen pattern would be 120 needles wide with needles Nos. 1, 121, 241, 361, 481, 601, 721, 841, 961, and 1081, all extending to the same feed roll since each of these needles represent or will tuft the first row of each of the ten repeating patterns.

It can be appreciated that the yarn strands which extend from a single feed roll to needles at different locations will be of different lengths which gives rise to tensioning problems. In present patterning machines where varying pile height capability is present, the deficiency in supplying yarn of varying tensions is partially overcome by carefully routing yarns from each feed roll to the respective needles in such a manner that the visible effect caused by the relative distance factors is minimized. Tubing commonly used for this type of routing is known as scramble tubes. Even with the use of scramble tubes, it is difficult to achieve the yarn tension control in a high-low patterning machine on the order of that achieved by a conventional non-patterning machine where the yarns can be fed directly from the feed roll to the needles without having to be routed in different directions as for example, some yarns in the two pile height patterning machine end up being routed diagonally from one end of the machine to the other.

A second detrimental aspect to present day, conventional high-low patterning is attributable to the fact that the clutch response is not instantaneous and since the distances from the feed roll may be as great as the width of the carpet, the pile height change does not occur completely until several cycles after the clutches are switched. It will be recognized that with this deficiency, the achievement of a clear pattern is difficult.

In conventional patterning high-low machines, in an effort to eliminate the difference in tension stretch in the yarns, accordingly, to produce a better defined pattern, rolls commonly known as pull rolls are utilized and located below the scramble tube bank. Presumably, all of the yarn is placed under tension in such a manner that the tension is presumably equalized. In practice, the result is far from an optimum one and weak yarns are likely to break at a weak point or a bad splice in the yarn.

Furthermore, with conventional patterning tufting machines, the limitation of a number of repeats, for example, 10, obviously limits the type of patterns which can be tufted. In machines heretofore used, there has been no commercially feasible way to control the height of each tuft of each tufting needle throughout the carpet.

Various principles utilized and some of the apparatus discussed herein are the subject matter of copending Application Ser. No. 699,905. Somewhat related subject matter is disclosed in co-pending Application Ser. Nos. 699,904 and 700,413.

SUMMARY OF THE INVENTION

In accordance with the subject invention, the apparatus and method disclosed herein provide a means of improving upon yarn feed for conventional high-low pattern tufting. Cumbersome, complex machinery used in the past can be eliminated and, because of a more direct path of yarn travel, many of the disadvantages of present day high-low pattern tufting which cause the production of poor quality carpets can be eliminated.

In place of the feed roll patterning concept and the requisite divergent yarn feeding, the subject invention utilizes a yarn pulling and clamping technique which is facilitated by individually actuatable band driven pullers which engage the yarn and meter and feed it directly to needles without the necessity of scramble tubes and pull rolls.

In a preferred embodiment, for each needle, a first yarn puller extends from a band-like member that is continuously driven by an oscillating shaft and upon each reciprocation of the band-like member, a length of yarn is drawn from the yarn creel. This yarn length may then be selectively advanced by any one of a plurality of yarn pullers which will advance only the desired amount of yarn. In the preferred embodiment, two such yarn pullers are shown and they are controlled in such manner that the deactuation of one yarn puller causes the actuation of the other yarn puller so that one of two pile heights will always be selected. Once this selection has been made, the yarn is clamped to prohibit additional yarn from being pulled from either the creel or a first yarn pocket where the yarn puller deposits the yarn drawn from the creel. Upon release of further clamping means, the selected, metered length of yarn can then be advanced to the tufting needle with the yarn under uniform tension with other yarns.

Further in accordance with the subject invention, the yarn pullers may be driven by thin band-like members, preferably constructed of steel, which are in turn driven by adjustable-stroke oscillatory shafts. These can be on the order as disclosed in co-pending Application U.S. Ser. No. 699,905. The bands extend tangentially from their respective shafts and are restrained in groove-like structure so that the path of the band is kept straight once it leaves the shaft. The yarn puller or plunger elements are secured to the bands at ends remote from the band end which is engageable by the oscillating shaft.

In the case of the yarn puller which initially pulls yarn from the creel (since this is a continually reciprocating puller) the band is continuously engaged by the oscillating shaft.

In the case of the selectable yarn metering pullers, if two such pullers are used, they may be connected to bands which are engageable with their respective shafts and which may be driven into or allowed to disengage from their respective shafts by the same control means. This may be a plunger which reciprocates to the right and left as driven by a solenoid or other means. Accordingly, upon receiving a pulse, the solenoid may cause the plunger to engage one of the bands with its oscillating shaft. Upon deenergization of the solenoid, the plunger will return to its rest position and, in so doing, will cause the first band to disengage with its driving shaft while causing a second band to be driven into engagement with its oscillating shaft. The shafts oscillate continually but only drive the bands when the bands are driven into engagement by the solenoid plunger means.

BRIEF DESCRIPTION OF THE DRAWINGS

For a more detailed understanding of the invention, reference is made in the following description to the accompanying drawings in which:

FIG. 5 is an isometric view showing band structure utilized in the subject invention;

FIG. 6 is an isometric view showing shaft structure together with a solenoid actuation means;

FIG. 7 is an isometric cut-away view showing housing structure together with shaft and plunger receptacles and the yarn channel;

DETAILED DESCRIPTION

Figures 1, 1A:
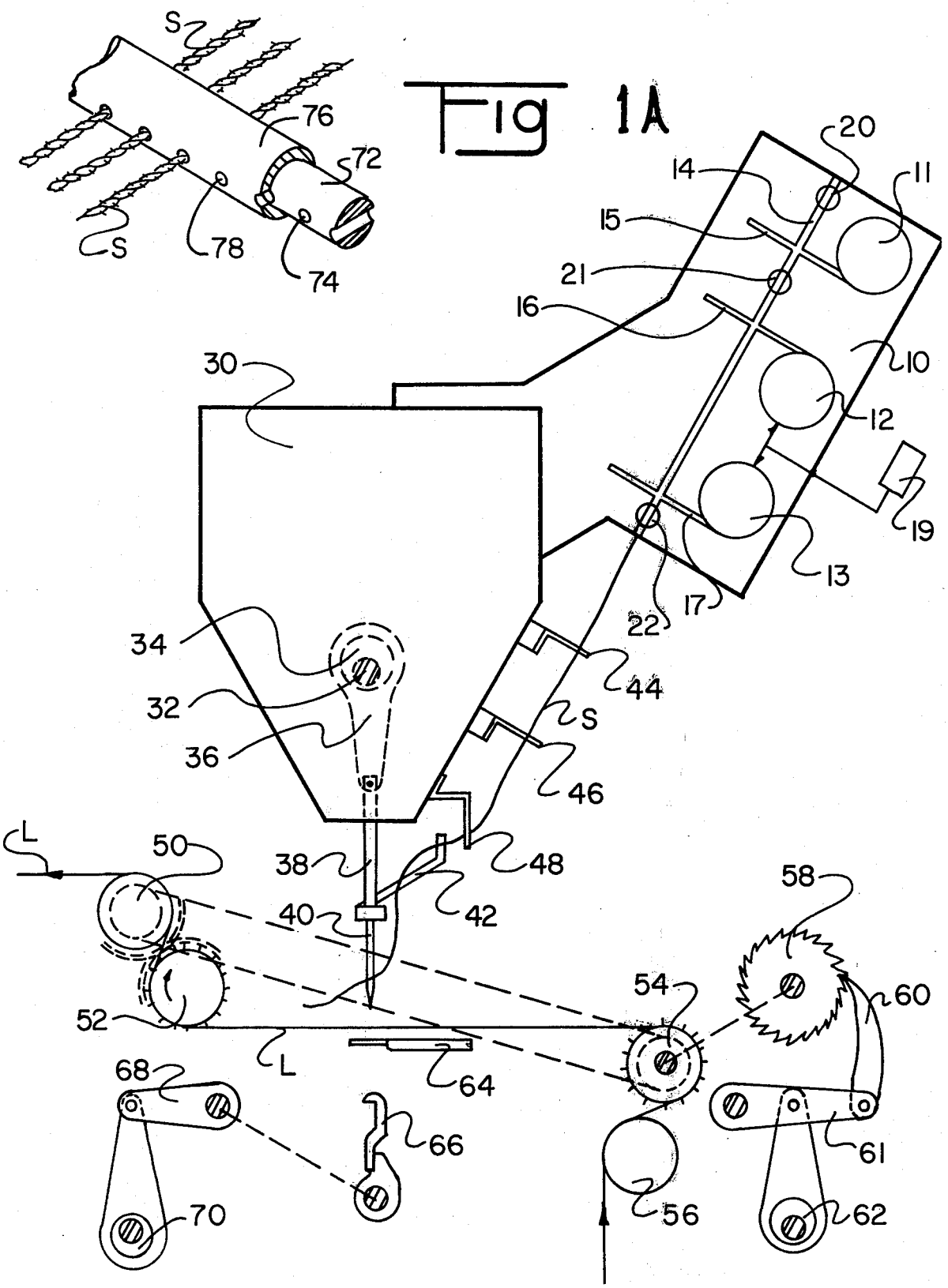
FIG. 1 is a schematic view showing conventional tufting apparatus, together with the improved yarn feeding system.
FIG. 1A is an isometric view showing a yarn clamp.

With reference to FIG. 1, conventional tufting equipment is shown schematically to which has been added the yarn feeding and metering system herein disclosed. The yarn feeding and metering components are shown schematically housed in unit housing 10. A feeding shaft 11 and two metering shafts, 12 and 13, are shown. A yarn passageway 14 extends from the creel (not shown) at the top of the figure to a point in closer proximity to the tufting station. Plunger channels 15, 16 and 17 are shown extending from shafts 11, 12 and 13, the purpose for which will be described subsequently. A solenoid actuator 19 is shown which, through appropriate linkage, will cause bands (not shown) to be engaged by shafts 12 and 13 as will also be described subsequently. Clamps 20, 21 and 22 are shown positioned along yarn passageway 14 and are used to clamp yarn extending through the passageway at intervals throughout the yarn feeding and metering process.

The remainder of the tufting unit of FIG. 1 represents a conventional tufting machine in which yarn S extends to the needle in much the same fashion as would be found in conventional non-patterning machines. A frame 30 is shown supporting the needle structure. A needle stroke shaft 32 is journalled within frame structure 30 and an eccentric 34 is secured to shaft 32 and actuates connecting rod 36. The connecting rod 36 is secured to push rod 38 which, in turn, is secured to needle 40. A needle yarn guide 42 forms the lowermost guide for the yarn strand S and additional yarn guides 44, 46 and 48 are shown as being secured to frame structure 30.

A backing layer L onto which yarn is tufted is fed to take-up roll 50 over backing guide 52 from feed roll 54 and idler roll 56. Feed roll 54 is driven by the ratchet 58 and pawl 60 drive which is controlled through linkage 61 by eccentric 62. A backing support 64 is shown, below which looper 66 is positioned to engage loops as they are tufted by needle 40. The looper 66 is driven by eccentric 70 through linkage 68.

While not shown, it is to be understood that a motor through suitable transmission apparatus will drive the various drive mechanisms such as eccentrics 70, 62 and 34 which drive various portions of the apparatus.

Having briefly described elements of the subject invention generally, these elements and their components will now be described in detail.

Yarn pullers or metering members which reciprocate within channels 16 and 17 are driven by bands which are engaged by shafts 12 and 13. As will be seen from FIG. 9, band-like member or ribbon 24 is engageable with shaft 12 and drives puller or plunger 28 in channel 16 and band-like member or ribbon 25 is engageable with shaft 13 and drives puller or plunger 29 in channel or pocket 17.

With reference to FIG. 1A, a clamp 20 is shown and it is to be understood that the same structure may be used for clamps 21 and 22. Clamp 20 comprises an inner solid cylindrical member 72 through which diametric bores 74 are made for yarn strands S. An outer cylindrical sleeve 76 has bores 78 alignable with the bores 74 of the inner solid cylindrical member 72. Relative motion between member 72 and sleeve 76 will cause the yarn to be clamped although movement cannot be so great as to shear the yarn strands. Each of the yarn strands S is fed through a separate feeding unit to a different needle 40 as will be clear from the following description.

Figure 2:
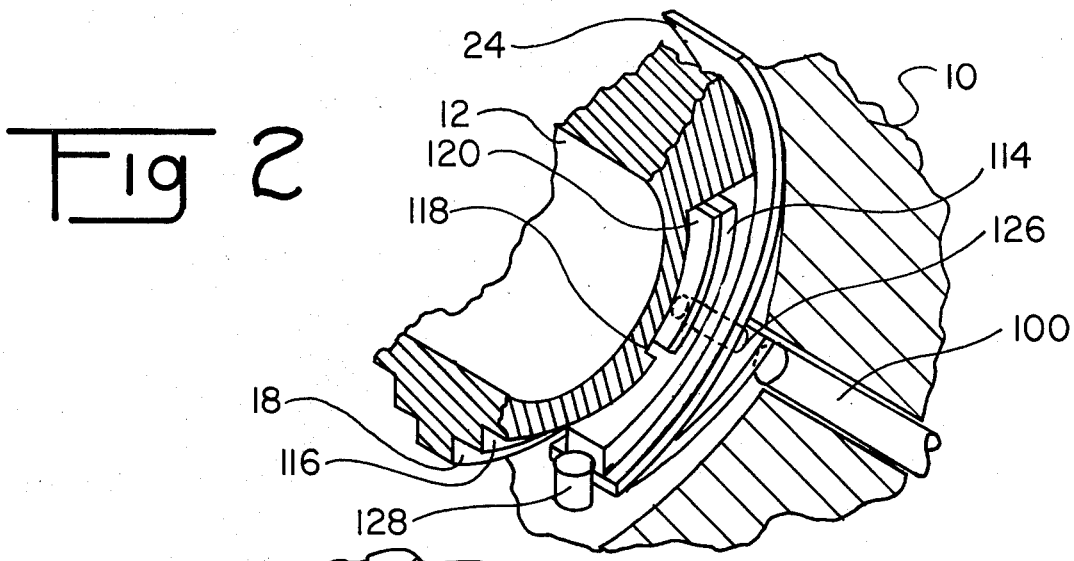
FIG. 2 is an isometric cut-away view showing an oscillatory member and band actuation structure.
Figure 3:
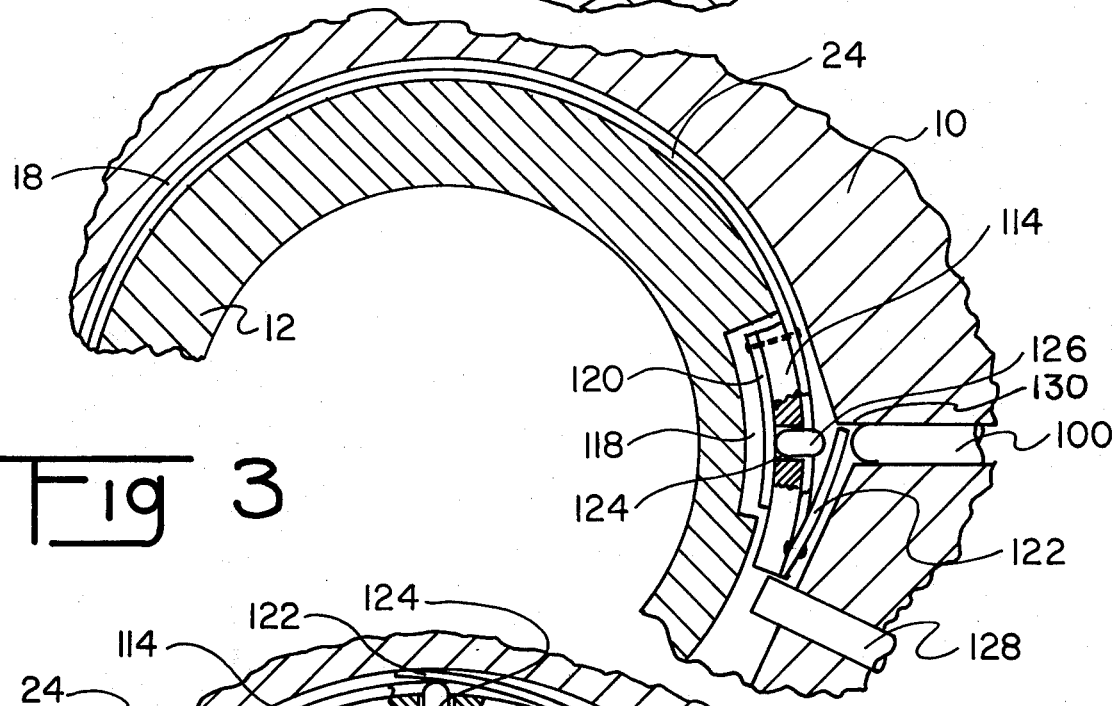
FIG. 3 is a cross-sectional plan view of the mechanism of FIG. 2 with a solenoid plunger in a deactuation position.
Figure 4:
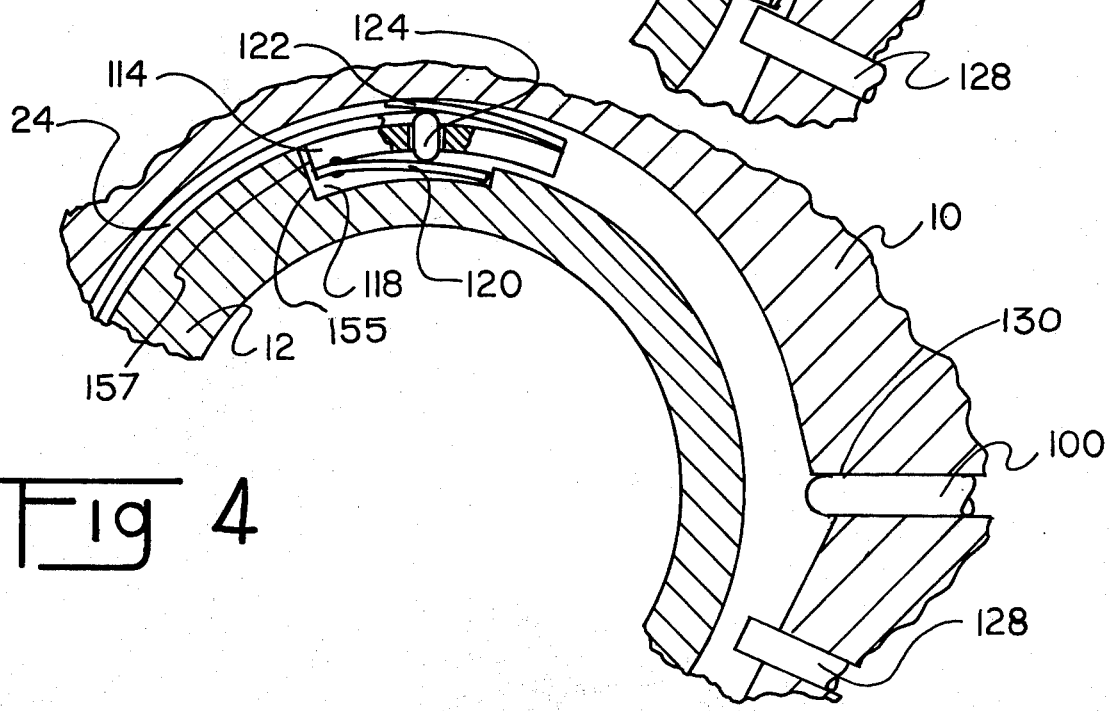
FIG. 4 is a cross-sectional plan view of the mechanism of FIG. 2 with the solenoid plunger shown in its actuating position.

With reference to FIGS. 2–4, the mechanism which causes the engagement of band 24 (which drives the puller in channel 16) by means of oscillating drive shaft or tube 12 is shown. The band or ribbon is contained in channel 18 and while it may slide, it will not bend when subjected to compression forces. As will be seen from FIGS. 5 and 9, the band or ribbon 24 extends to plunger 28 which is in the stationary channel 16 (see FIG. 1) below the oscillatory shaft 12. The band or ribbon 24 thus extends upwardly from plunger 28 around the shaft 12 for approximately 180° and terminates in a shoe 114. As can be seen from the partial view in FIG. 2, shaft 12 closely fits within a cavity formed in housing 10 and groove 18 which carries band 24 in actually the shallowest of three grooves or notches in shaft 12. Shoe 114 is positioned within intermediate groove 116 which extends partially around the shaft. A third deeper notch or groove 118 has a purpose which will be described subsequently.

The shoe 114 may be welded, soldered or otherwise attached to band or ribbon 24. A drive spring 120 is welded or soldered or otherwise attached to the base of shoe 114 and extends along part of the distance of shoe 114. It will be noted that the ribbon or band 24 has a portion of its center cut out to give a lanced out tab 122, (see FIG. 5). The shoe 114 has a cavity 124 in which is contained a compressible pin 126 which bears against drive spring 120 and which extends through the lanced out portion of band or ribbon 24. The compressible pin 126 may be constructed of a rubber-like substance. A stop member 128 is rigidly secured to and embedded within housing structure 10. The left tip of actuation pin 100 is shown in its non-energized position in FIGS. 2 and 3. When plunger or actuation pin 100 is as shown in FIGS. 2 and 3, the ribbon or band-like member 24 is held out of action due to the interference of lanced out tab 122 with surface 130 of housing 10. The band or ribbon 24 is prevented from being driven in a clockwise direction by stop member 128 as can be seen in FIGS. 2 and 3.

When a particular pile height is to be selected and hence the band or ribbon 24 of that unit is to be actuated, the plunger or actuation pin 100 is advanced thus unlatching spring 122 from surface 130. As spring 122 is unlatched, it applies pressure to the compressible pin 126 which, in turn, depresses the drive spring 120. As can be seen best in FIG. 3, the drive spring 120 is attached to only one end of shoe 114 and thus can be driven outwardly from the shoe by compressible pin 126 if permitted by the notch structure of shaft 12. As the shaft oscillates, it will reach the position as shown in FIG. 3 at which time the compressible pin 126 will force the lower end of drive spring 120 into engagement with notch 118. As the shaft 12 reverses, drive spring 120 will be driven in the counterclockwise direction, thus driving band member 24. As the band or ribbon 24 advances the lanced out portion or tab 122 of the ribbon or band 24 becomes trapped within groove 18 formed between the shaft and the stationary housing 10 (as seen in FIG. 4) with the drive spring 120 being held in its drive position.

Figure 9:
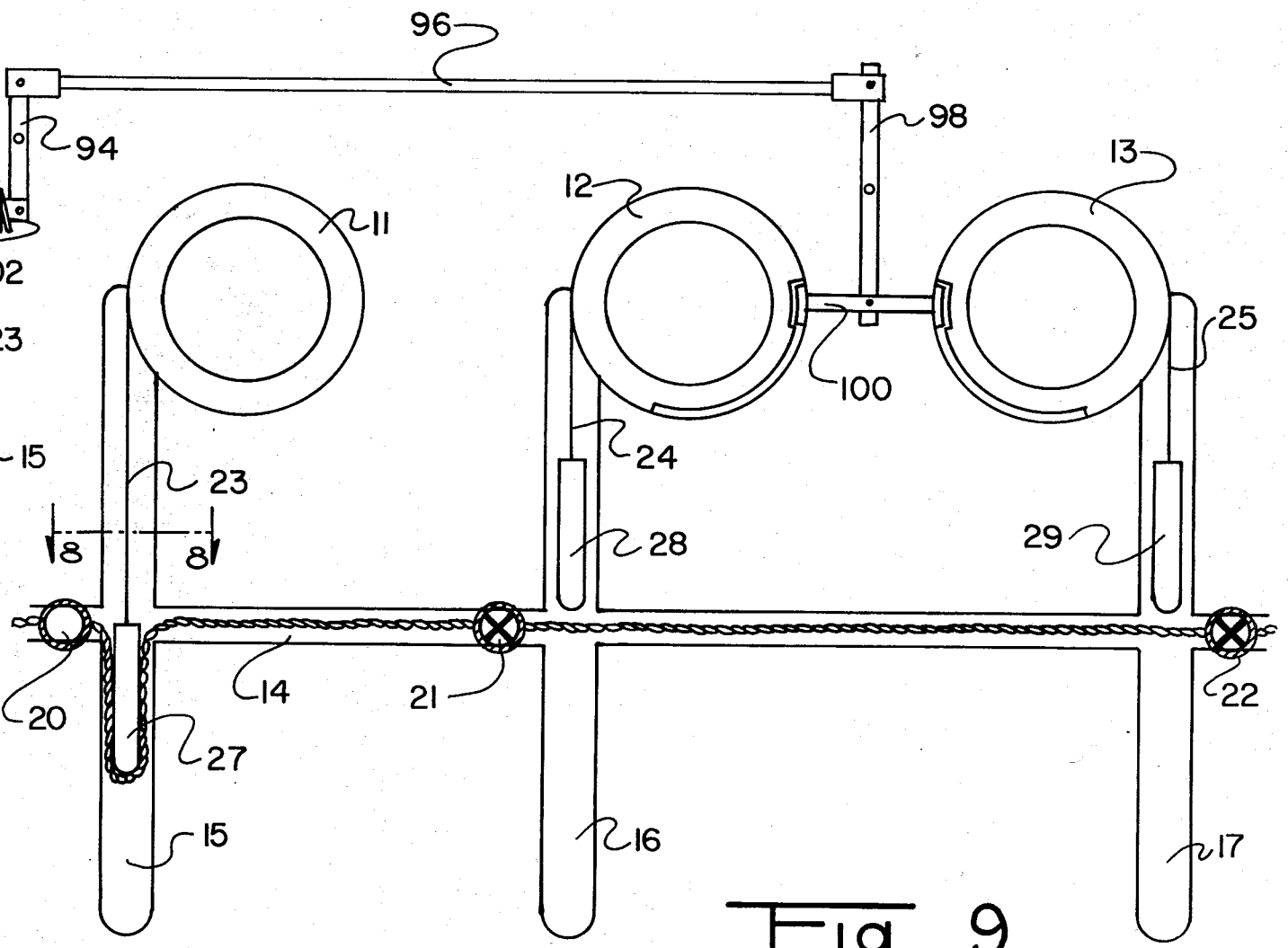
FIG. 9 shows the subject yarn feeding and metering system and is the first of a series of sequential drawings showing feeding and metering steps.

Thus, as can be seen in FIG. 4, the band or ribbon 24 is driven as far as the oscillatory motion of the shaft carries it since the drive spring 120 is engaged in the driving or deepest notch 118. As this counterclockwise motion of band 24 occurs, it will be appreciated that plunger 28 of FIG. 9 is driven downwardly within pocket or plunger channel 16 and will, as will be described, be engaging yarn.

As the shaft 12 oscillates in a clockwise direction, surface 155 of shaft 12 engages surface 157 of shoe 114 whereby band 24 will be returned to its unactuated position and if actuation pin 100 has been deactivated by the solenoid means, then the lanced out tab 122 will be permitted to return to its position where it abuts against surface 130. Compressible pin 126 will, accordingly, be permitted to release its pressure against drive spring 120 which will return to its non-driving position in juxtaposition against shoe 114 and out of engagement with notch 118. Thus, the next time the shaft 12 oscillates in a counterclockwise direction, the band 24 will remain in its stationary non-actuated position. On the other hand, if the same height is to be called for a second time in succession, the solenoid is left alone and the actuation pin or plunger 100 remains in the position as shown in FIG. 4 thus causing the band 24 to be driven by oscillating shaft 12 for a second cycle.

With reference to FIG. 5, the bands 24 and 25 are shown in isometric views and are shown attached to yarn pullers or plungers 28 and 29, respectively. Engagement elements such as shoe 114, drive spring 120 and lanced out tab 122 are shown by identical numerals on each of the bands 24 and 25.

With reference to FIG. 6, shafts 12 and 13 are shown in isometric views together with the solenoid actuation unit. The solenoid 92 is shown operatively connected to plunger or actuation pin 100 by intermediate elements 94, 96 and 98. As can be seen, the actuation pin 100 is placed so that when in the off condition, the plunger 100 is biased by spring 102 to the right to cause engagement with the structure to the right. This means band 25 will be forced into engagement with shaft 13. When the solenoid 92 is actuated, the spring biasing 102 will be overcome and actuation pin 100 will disengage from the structure to the right and cause the engagement of band 24 with shaft 12 to the left of the plunger 100. As can be seen from the perspective in FIG. 6, actuation pins 100 can be placed side-by-side although each succeeding unit is independently actuable through its own solenoid unit.

With reference to FIG. 7, a portion of housing 10 is shown. In particular, cavity 200 which houses clamp 21 and cavity 202 which houses clamp 22 are each along yarn passageway 14. Plunger channels 16, 17 intersect passageway 14 and house plungers 28 and 29 respectively. Each plunger channel or pocket 16 and 17 has a vertical groove 208 and 210, respectively. The edges of bands 24 and 25 are inserted and confined within the vertical grooves 208 and 210, respectively to confine the bands in a linear direction as they extend tangentially outward from the shafts 12 and 13, respectively. By restraining bands 23, 24 and 25 as will be discussed, the oscillatory motion of the shafts can be translated to reciprocable motion of plungers 27, 28 and 29. Shafts 12 and 13 are housed in cavities 212 and 214, respectively, while plunger 100 reciprocates in cavity 216 which extends upwardly as well to house linkage member 98.

Figure 8:
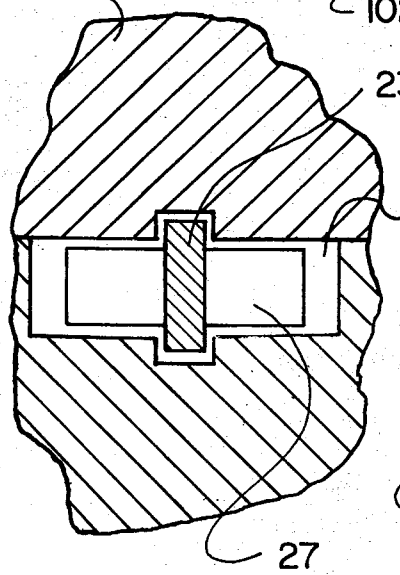
FIG. 8 is a cut-away cross-sectional view taken along lines 8—8 of FIG. 9.

With reference to FIG. 8, a cross-sectional view is taken in channel 15 looking down from the above plunger 27. As can be seen, the band 23 is secured within channels to prevent any bending or deformation of the band.

With reference to FIG. 9, a more detailed view of the yarn feeding and metering apparatus is disclosed. Yarn comes from a creel (not shown) to the left of the apparatus and extends through passageway 14 (through the housing) to guides 44, 46 and 48 (see FIG. 1) and subsequently to the needles 40. As can be seen in FIG. 9, oscillating shaft 11 drives band 23 to which plunger 27 is connected. Since plunger 27 reciprocates to draw a length of yarn from the creel for each cycle, it is not necessary to have an engaging mechanism as disclosed in FIGS. 2–4 since the band 23 may be held in continuous engagement with oscillating shaft 11 by any convenient means of attachment such as rivet, screw or other common fastener. To the right of shaft 11, shafts 12 and 13 are shown which are adjustable in their oscillatory amplitude to carry out the metering function. Bands 24 and 25 are shown extending to yarn plungers or pullers 28 and 29, respectively. The yarn pullers or metering members 28 and 29 are designed to penetrate downwardly to different levels, thereby providing different metering capabilities and, accordingly, a different height pile is obtained depending upon which unit is chosen. As will be seen, when plunger 28 is chosen, it will descend to a previously adjusted level so that most of the yarn pulled from the creel by plunger 27 is used. On the other hand, when plunger 29 is chosen and descends, shaft 13 would normally be adjusted to utilize only part of the yarn in pocket 15 and, accordingly, on the next descent of plunger 27, a lesser amount need be pulled from the creel. The clamps 20, 21 and 22 are important in the operation of the feeding and metering of yarn and the clamps are in closed positions when marked by an X as clamps 21 and 22 are shown in FIG. 9.

With further reference to FIG. 9, when solenoid 92 is in the off position, the plunger 100 is biased to the right to engage band 25 with shaft 13, thus actuating plunger 29. Since plunger 29 has been designated as the metering means for the shorter pile, then the short pile will be chosen until such time as the solenoid is actuated, and plunger 100 is pulled to the left to engage band 24 with shaft 12, thus causing the selection of the unit which was chosen to provide the longer pile height.

With further reference to FIG. 9, it is to be further understood that the metering and feeding of two different lengths of yarn occurs during two successive machine cycles. Since the design of the yarn feed can be made on gauge, every needle has its own independently controlled feed and, accordingly, there are no pattern restrictions.

It is to be further understood that yarn plunger 27 always pulls from the creel and stores a length of yarn which may be somewhat greater than that needed by plunger 28 which is the highest pile plunger. This assures that when the clamp isolating pocket 15, i.e., clamp 21, from the meter pockets 16 and 17 is released and the tension goes to zero, there will always be enough yarn to transfer to the metering pockets 16 or 17 at zero tension.

Clamp 20 or the creel clamp serves to isolate the creel and its tension from the metering pockets 16 and 17. It is unclamped when the creel puller or plunger 27 is moving downward and clamped when puller 27 is moving upward.

The center clamp 21 has two primary functions. It isolates the yarn on its downstream side so that the creel puller 27 pulls yarn only from upstream (the creel) and does not allow the tension of creel pulling into the metering section. Secondly, it releases yarn pulled from the creek only after creel clamp 20 is clamped.

The feed clamp 22 prevents yarn from being pulled from the needles 40 while being transferred from the creel pocket 15 to either of the metering pockets 16, 17 and also is timed for proper release of metered yarn to needles after the meter clamp 21 is clamped.

FIG. 9 is now to be viewed as the first figure of sequential drawings FIGS. 9–12. As can be seen in FIG. 9, the creel pulling is almost complete as creel puller or plunger 27 reaches its full descent. Clamp 20 is off or unclamped to allow the yarn to be pulled from the creel while clamp 21 is clamped to prevent yarn from being pulled from the metering and needle areas toward creel puller 27. The center meter (high pile) is to be selected for high pile and thus, the solenoid 92 is actuated.

Figure 10:
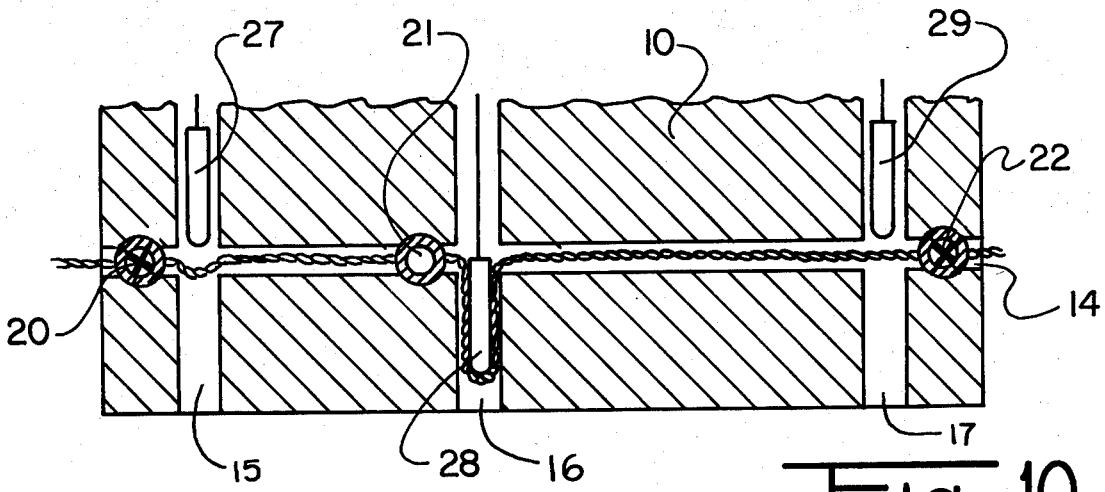
FIG. 10 is the second of a series of sequential views.

With reference to FIG. 10, clamp 20 is on in its clamping position and yarn creel puller or plunger 27 ascends. Clamp 21 is turned off while clamp 22 remains on. Plunger 28 descends pulling the yarn from creel pocket 15 into the metering pocket 16.

Figure 11:
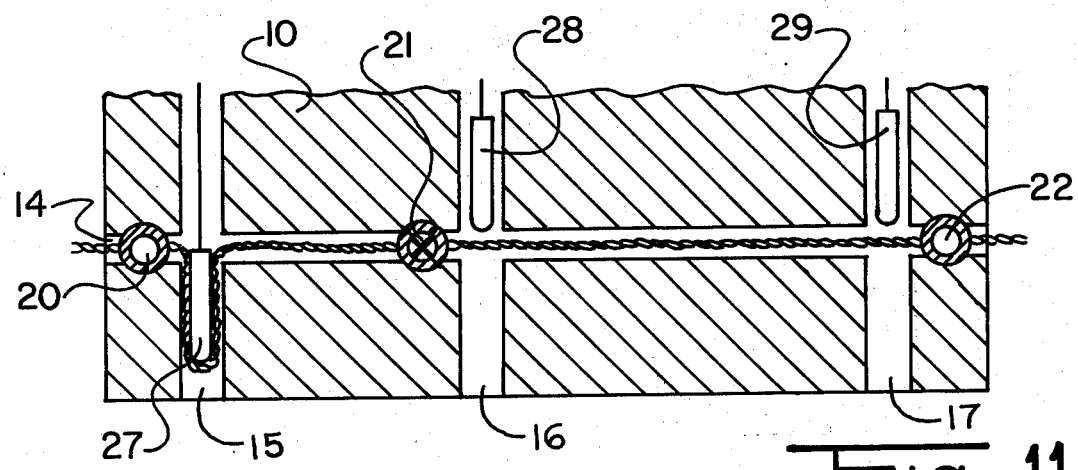
FIG. 11 is the third of a series of sequential views.

With reference to FIG. 11, clamp 21 is turned on while clamp 22 is off to permit the yarn metered in pocket 16 to be pulled on through by the needles. Also, since clamp 21 is on, yarn puller 27 may now descend to draw the next length of yarn from the creel as clamp 20 has now been released.

Figure 12:
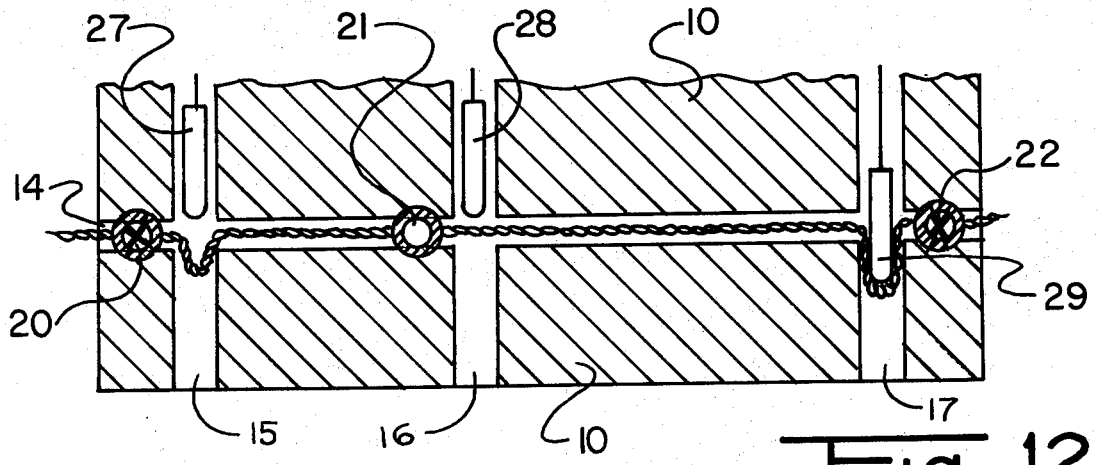
FIG. 12 is the fourth of a series of sequential views.

FIG. 12 shows clamp 20 back on the plunger 27 raised. Clamp 21 has been released and the low pile has been selected for the next tuft and thus, plunger 29 has descended since solenoid 92 is deactuated causing band 25 to be engaged by oscillating shaft 13. The actuation of the solenoid can be made at any time after the position reached in FIG. 10 but before the position reached in FIG. 11.

Accordingly, the many advantages of the subject system can now be appreciated. The pile height change now will occur in the system disclosed herein without the gradual tapering that has been a problem in other high-low patterning systems used to date. It is not necessary to effectuate changes through clutches and therefore it is of no concern that responses to clutches are not instantaneous and that full changes do not occur completely until several cycles after the clutches are switched.

The tension in the above-disclosed system can be held to a more uniform state since the distance from the metering area to the needles remains the same for all yarns. With the subject system, there is no need to utilize feed rolls with yarns stretched through scramble tubes to all areas of the tufting machines to enable pattern repeat.

Additional compensatory apparatus such as pull rolls, which are used to eliminate any discrepancies in yarn tension are not needed with the system disclosed herein. Furthermore, and of particular importance, is that with the present apparatus disclosed herein, there are no pattern restrictions. The entire machine will have only three drive tubes with shafts, i.e., 11, 12 and 13, and every needle has its own independently controlled feed which may be so controlled for every needle stroke. This enables wider variations in patterning without the necessity of predetermined repeats.

It will be understood that solenoid 92 receives control signals for selective actuation of plungers or yarn pullers 28, 29. Pattern information such as recorded on tape, drums or other media is converted into electrical or other type signals which are then transmitted to the solenoids 92 in synchronism with the operation of the machine.

It should be noted that with respect to the construction of the band-like member and the oscillating shaft, the smaller the shaft is, the thinner the band must be. Since the band should not take permanent deformation, Hook's Law of Stress should not be surpassed. While hardened stainless steel is preferred for the band-like member, plastic bands and other metal bands can be used as well, so long as they do not take permanent deformation. As an example, it has been found that stainless steel bands on the order of 1/100 of an inch in thickness are acceptable for the operations discussed herein using a five inch drive shaft.

The present invention may be embodied in other specific forms without departing from the spirit or essential attributes thereof, and accordingly, reference should be made to the appended claims, rather than to the foregoing specification as indicating the scope of the invention.

What is claimed is:

1. Tufting apparatus or the like including means for metering and feeding lengths of yarn from a creel to a tufting needle comprising:
   - a creel pulling member engageable with the yarn and positioned to pull a length of yarn from the creel;
   - a first metering member for selectively metering a predetermined length of yarn to be fed to said tufting needle;
   - a second metering member for selectively metering a different predetermined length of yarn to be fed to said tufting needle; and
   - yarn clamping means operable to engage and release yarn during each feeding and metering cycle.

2. The tufting apparatus or the like of claim 1 wherein said yarn clamping means comprises:
   - a first clamp member positioned between said creel and said creel pulling member;
   - a second clamp member positioned between said creel pulling member and said first metering member; and
   - a third clamp positioned between said second metering member and said tufting needle.

3. The apparatus of claim 1 wherein said first and second metering members are commonly controlled wherein the actuation of one of said first or second metering members causes the deactuation of the other of said first or second metering members.

4. The apparatus of claim 1 wherein said creel pulling member continually reciprocates to pull lengths of yarn from the creel.

5. The apparatus of claim 1 wherein at least one of said metering members is driven by:
   - an oscillatory member; and
   - a flexible band-like member connected to said metering member and engageable by said oscillatory member, said band-like member being extendable within a track that extends from said oscillatory member to said at least one metering member, said extending track preventing unwanted flexing of said band-like member, said at least one metering member being reciprocable when said band-like member is engaged by said oscillatory member.

6. The apparatus of claim 5 wherein one of said oscillatory or band-like members has a notch and the other has a protrusion, said apparatus further comprising means of driving said protrusion into said notch to cause said band-like member to be engaged by said oscillatory member.

7. The apparatus of claim 5 wherein a portion of said structure adjacent said oscillatory member has an abutment, and wherein said band-like member includes a portion engageable with said abutment to prevent movement of said band-like member unless actuated.

8. The apparatus of claim 7 further including plunger means for driving said engageable portion of said band-like member free from said abutment and for driving said band-like member into engagement with said oscillatory member.

9. The apparatus of claim 5 further including a means for causing said band-like member to become engaged with said oscillatory member.

10. The apparatus of claim 9 wherein said means for causing engagement comprises a solenoid and a solenoid plunger element.

11. Tufting apparatus or the like including apparatus for metering and feeding lengths of a strand of yarn from a creel to a tufting station comprising:
   - a creel pulling member engageable with the yarn strand and positioned to pull a length of yarn from the creel;
   - a first clamp member positioned between said creel and said creel pulling member;
   - a first metering member for metering a predetermined length of yarn;
   - a second clamp member positioned between said creel pulling member and said first metering member;
   - a second metering member positioned between said first metering member and said tufting station for metering a different predetermined length of yarn; and
   - a third clamp member positioned between said second metering member and said tufting station.

12. Apparatus for feeding lengths of a strand of yarn comprising:
   - at least one pulling member for feeding a length of yarn;
   - an oscillatory member for driving said pulling member; and
   - a flexible band-like member connected to said pulling member engageable by said oscillatory member, said band-like member being extendable within a track that extends from said oscillatory member to said pulling member, said track preventing unwanted flexing of said band-like member, said pulling member being reciprocable when said band-like member is engaged by said oscillatory member.

13. Apparatus for feeding lengths of yarn to a working station comprising:
   - at least one yarn pulling member for feeding a length of yarn;
   - driving means for said yarn pulling member; and
   - a flexible band-like member connected to said pulling member engageable by said driving means, said band-like member being extendable within a track that extends from said driving means to said pulling member, said track preventing unwanted flexing of said band-like member, said pulling member being reciprocable by said band-like member to pull lengths of yarn.

14. A method of tufting wherein yarn is fed to a tufting needle from a creel comprising the steps of:
   - pulling by a first pulling element a length of yarn from the creel while the yarn is clamped to prevent it from being pulled from the opposite direction;
   - clamping the yarn extending between the first pulling element and the creel;
   - selectively pulling all or part of said length of yarn by one of a plurality of yarn pullers during a time when the yarn extending to said tufting needle is clamped whereby different lengths of yarn can be selectively fed to said needle; and
   - releasing the yarn extending to said tufting needle to permit said selected length of yarn to be tufted by said tufting needle.

15. A method of tufting wherein two different yarn lengths are fed to a tufting needle from a creel through a series of three yarn pullers with a first yarn clamp positioned between the first yarn pullers with a first yarn clamp positioned between the first yarn puller and the creel, a second yarn clamp positioned between the first yarn puller and the second yarn puller, and a third yarn clamp positioned between the third yarn puller and the tufting needle comprising the steps of:

pulling a length of yarn by said first yarn puller from said creel while said first clamp is unclamped and said second clamp is clamped;

pulling all or part of said length of yarn by said second or third puller depending on which of said second or third pullers is chosen while said first clamp is clamped, said second clamp is unclamped and said third clamp is clamped; and allowing said yarn between said second and said third clamp to be drawn to said tufting needle by clamping said second clamp and unclamping said third clamp.

* * * * *

UNITED STATES PATENT OFFICE

CERTIFICATE OF CORRECTION

Patent No. 4,062,308 Dated December 13, 1977

Inventor(s) Abram N. Spanel, P. Frank Eiland and David R. Jacobs

It is certified that error appears in the above-identified patent and that said Letters Patent are hereby corrected as shown below:

Column 2, line 7, before "accordingly," insert --and--.

Column 2, line 52, after "such", insert --a--.

Column 7, line 57, delete "creek" and insert --creel--.

Column 8, line 15, delete "the" and insert --and--.

Column 8, line 39, delete "machines" and insert --machine--.

Column 11, lines 5-6, delete "pullers with a first yarn clamp positioned between the first yarn".

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademark*